US007628354B2

(12) United States Patent
Lee et al.

(10) Patent No.: US 7,628,354 B2
(45) Date of Patent: Dec. 8, 2009

(54) APPARATUS FOR DEPLOYING WING OF GUIDED MISSILE

(75) Inventors: Yeol-Hwa Lee, Daejeon (KR); Young-Sug Shin, Daejeon (KR); Hae-Sug Yang, Daejeon (KR); Cheol-Gyuh Hwang, Daejeon (KR)

(73) Assignee: Agency for Defense Development, Daejoen (KR)

( * ) Notice: Subject to any disclaimer, the term of this patent is extended or adjusted under 35 U.S.C. 154(b) by 547 days.

(21) Appl. No.: 11/441,732

(22) Filed: May 26, 2006

(65) Prior Publication Data

US 2007/0102567 A1 May 10, 2007

(30) Foreign Application Priority Data

Sep. 14, 2005 (KR) ..... 10-2005-0085936

(51) Int. Cl.
*F42B 10/06* (2006.01)

(52) U.S. Cl. ..... 244/3.29

(58) Field of Classification Search ..... 244/3.29, 244/3.28, 3.27, 49, 3.24
See application file for complete search history.

(56) References Cited

U.S. PATENT DOCUMENTS

| | | | | | |
|---|---|---|---|---|---|
| 2,867,841 | A * | 1/1959 | Baldauf | ..... | 16/308 |
| 3,273,500 | A * | 9/1966 | Kongelbeck | ..... | 244/3.28 |
| 4,460,137 | A * | 7/1984 | Andersson et al. | ..... | 244/3.27 |
| 5,820,072 | A * | 10/1998 | Na et al. | ..... | 244/49 |
| 6,092,264 | A * | 7/2000 | Banks | ..... | 16/321 |
| 2007/0045466 | A1 * | 3/2007 | Hellis | ..... | 244/3.29 |

* cited by examiner

*Primary Examiner*—Tien Dinh
(74) *Attorney, Agent, or Firm*—Scully, Scott, Murphy & Presser, P.C.

(57) ABSTRACT

An apparatus for deploying a wing of a guided missile comprises a fixed wing fixedly coupled to a body of a guided missile, a rotary wing rotatably coupled to the fixed wing, and a deploying portion for rotating the rotary wing into an unfolded state from a folded state by providing a torsion force to the rotary wing. In the apparatus, a folded degree of the rotary wing can be maximized.

12 Claims, 9 Drawing Sheets

APPARATUS FOR DEPLOYING WING OF GUIDED MISSILE

BACKGROUND OF THE INVENTION

1. Field of the Invention

The present invention relates to an apparatus for deploying a wing of a guided missile, and more particularly, to an apparatus for deploying a wing of a guided missile capable of deploying a rotary wing centering around a fixed wing fixed to the guided missile and maintaining the deployed state of the rotary wing.

2. Description of the Background Art

A guided missile mounted at an aircraft, etc. is accommodated in a launcher under a state that a wing thereof is folded. Generally, the guided missile has to be accommodated in the launcher under a state that a wing thereof is folded with an angle of approximately 104~ 110° in a longitudinal direction thereof in order to prevent a restriction on an outer diameter of the launcher and an interference with other components.

The guided missile mounted at the launcher under a state that a wing thereof is folded is separated from the launcher, and then the wing is automatically rotated thus to be deployed so as to be in consistent with a longitudinal direction of the guided missile. Then, the deployed state is fixed thereby to allow the guided missile to freely fly.

The wing deploying/fixing components have to be installed at a narrow space inside the wing so as not to be outwardly protruding so that an aerodynamic drag of the wing can be minimized.

In the conventional art, a torsion spring or a torsion bar has been used in order to deploy the wing.

However, in case of using the torsion spring, an entire volume of the wing deploying apparatus is increased. Also, the torsion spring can not be installed in plurality due to a limitation of a shape of the wing and a chord length.

In case of using the torsion bar, a folding of the wing can not be implemented due to a limitation of an allowable torsion force of the torsion bar. To solve the problem, a length of the torsion bar is increased. However, it is difficult to increase the length of the torsion bar due to several limitations.

Furthermore, fixing the wing of the guided missile that has been deployed simply and firmly is not easily implemented. Also, when the deployed state of the wing has been fixed, a free play is generated thereby to serve as an obstacle at the time of the guided missile flight.

BRIEF DESCRIPTION OF THE INVENTION

Therefore, an object of the present invention is to provide an apparatus for deploying a wing of a guided missile capable of maximizing a folded range of the wing.

Another object of the present invention is to provide an apparatus for deploying a wing of a guided missile capable of firmly fixing a deployed wing by a simple structure.

Still another object of the present invention is to provide an apparatus for deploying a wing of a guided missile capable of minimizing even a minute free play of a fixed wing.

To achieve these and other advantages and in accordance with the purpose of the present invention, as embodied and broadly described herein, there is provided an apparatus for deploying a wing of a guided missile, comprising: a fixed wing fixedly coupled to a body of a guided missile; a rotary wing rotatably coupled to the fixed wing; and a deploying portion for rotating the rotary wing into an unfolded state from a folded state by providing a torsion force to the rotary wing.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Hereinafter, an apparatus for deploying a wing of a guided missile according to a preferred embodiment of the present invention will be explained with reference to the attached drawings.

Figure 1:
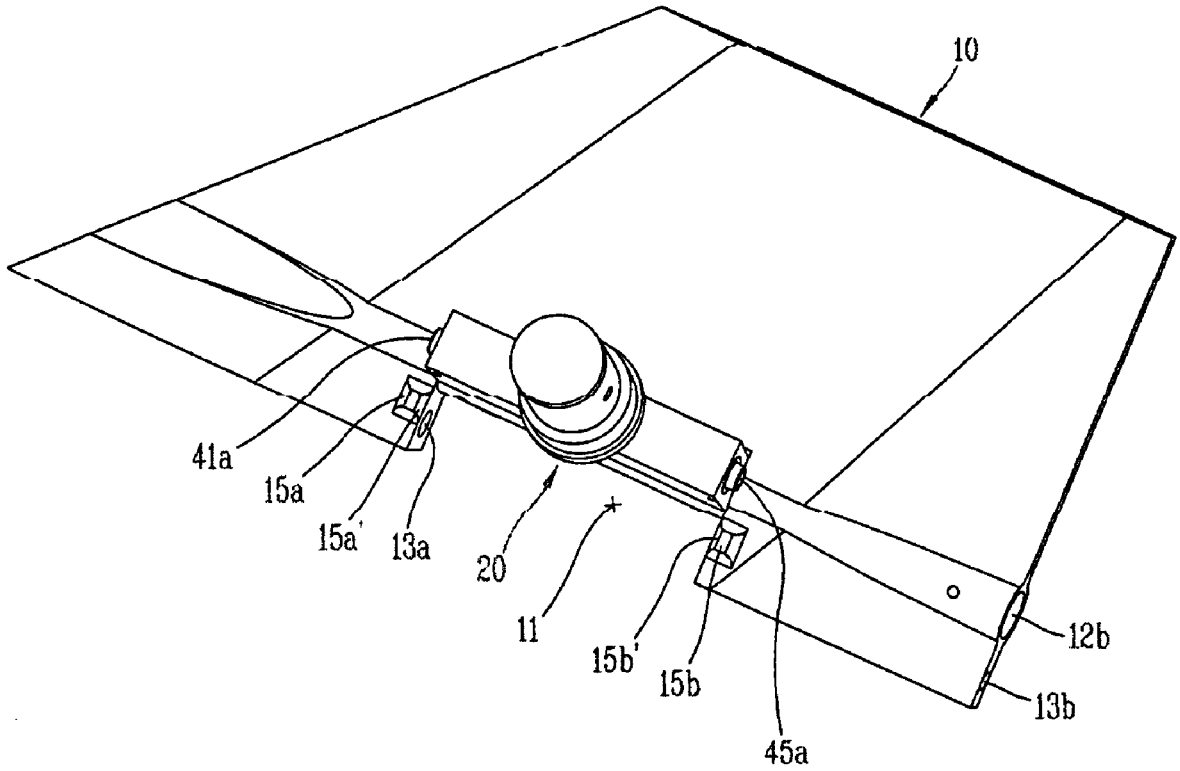
FIG. 1 is a perspective view showing a rotary wing and a fixed wing coupled to a body of a guided missile.

FIG. 1 is a perspective view showing a rotary wing and a fixed wing coupled to a body of a guided missile.

The apparatus for deploying a wing of a guided missile according to a preferred embodiment of the present invention comprises a rotary wing 10, a fixed wing 20, a deploying portion 30, and a locking means 40.

The rotary wing 10 is designed with consideration of an aerodynamic characteristic to allow the guided missile to fly, and has a trapezoid shape having a certain thickness. A cut-out coupling portion 11 cut out as a rectangular shape and inserting the fixed wing 20 is formed at a middle portion of a lower end of the rotary wing 10.

Upper spaces 12*a* and 12*b* and lower spaces 13*a* and 13*b* (also see FIG. 2A) are formed from a right edge of the rotary wing 10 to a left certain portion. A deploying portion 30 (see FIG. 3A) for deploying the rotary wing 10 of a folded state so as to be parallel with the fixed wing 20 is inserted into the upper spaces 12*a* and 12*b*. Also, a locking means 40 (see FIG. 4A) for fixing the rotary wing 10 that has been deployed is inserted into the lower spaces 13*a* and 13*b*.

Rotary protrusions 15*a* ad 15*b* for supplementing the locking means 40 at the time of fixing the rotary wing 10 are protruding at both side surfaces of the cut-out coupling portion 11 with inclination surfaces 15*a'* and 15*b'*.

As aforementioned, the rotary wing 10 is rotatably coupled to the fixed wing 20 by the deploying portion 30. To this end, the fixed wing 20 has upper spaces 22*a* and 22*b*(see FIG. 4A) penetrated to be positioned in a straight line with the upper spaces 12*a* and 12*b* of the rotary wing 10. Also, lower spaces 23*a* and 23*b* are penetrated so as to be positioned in a straight line with the lower spaces 13*a* and 13*b* of the rotary wing 10 below the upper spaces 22*a* and 22*b*. The locking means 40 is inserted into the lower spaces 23*a* and 23*b*.

The rotary wing 10, the fixed wing 20, the deploying portion 30, and the locking means 40 will be explained in more detail with reference to FIGS. 2A to 4B.

Figure 2A:
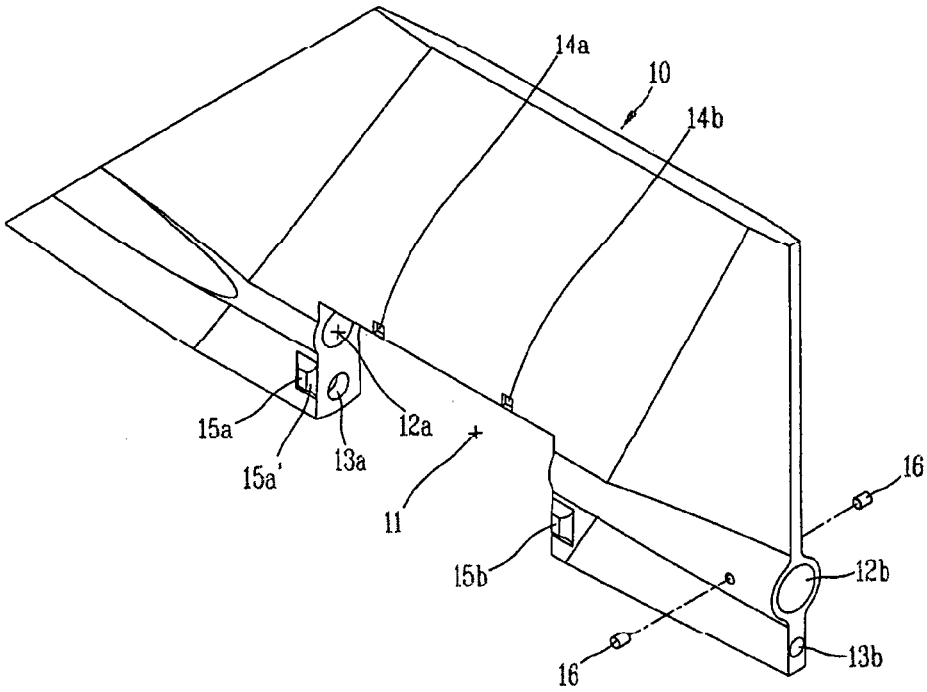
FIG. 2A is a perspective view showing the rotary wing of FIG. 1.
Figure 2B:
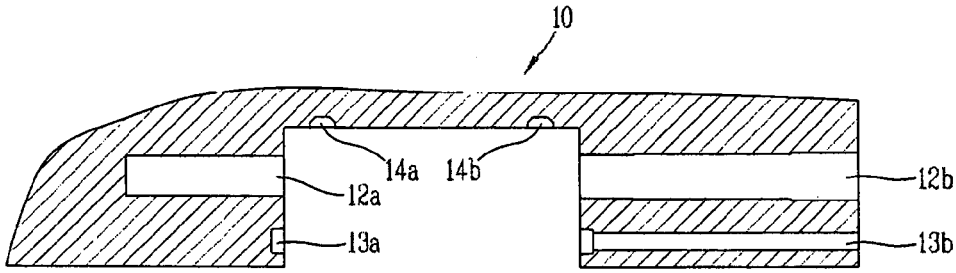
FIG. 2B is a sectional view showing the rotary wing of FIG. 1.

FIG. 2A is a perspective view showing the rotary wing, and FIG. 2B is a sectional view showing the rotary wing.

The upper spaces 12*a* and 12*b* and the lower spaces 13*a* and 13*b* respectively opened as a channel shape are formed at both sides of the cut-out coupling portion 11 of the rotary wing 10. The left upper and lower spaces 12*a* and 13*a* are opened up to a certain distance from the cut-out coupling portion 11. On the contrary, the right upper and lower spaces 12*b* and 13*b* are completely opened up to the right end of the rotary wing 10. Two protrusion grooves 14*a* and 14*b* are concaved at an upper side of the cut-out coupling portion 11. The rotary protrusions 15*a* and 15*b* are formed at both sides of the cut-out coupling portion 11 in correspondence with the lower spaces 13*a* and 13*b*. A fixing pin 16 fixes the deploying portion 30 inserted into the upper space 12*b*.

Figure 3A:
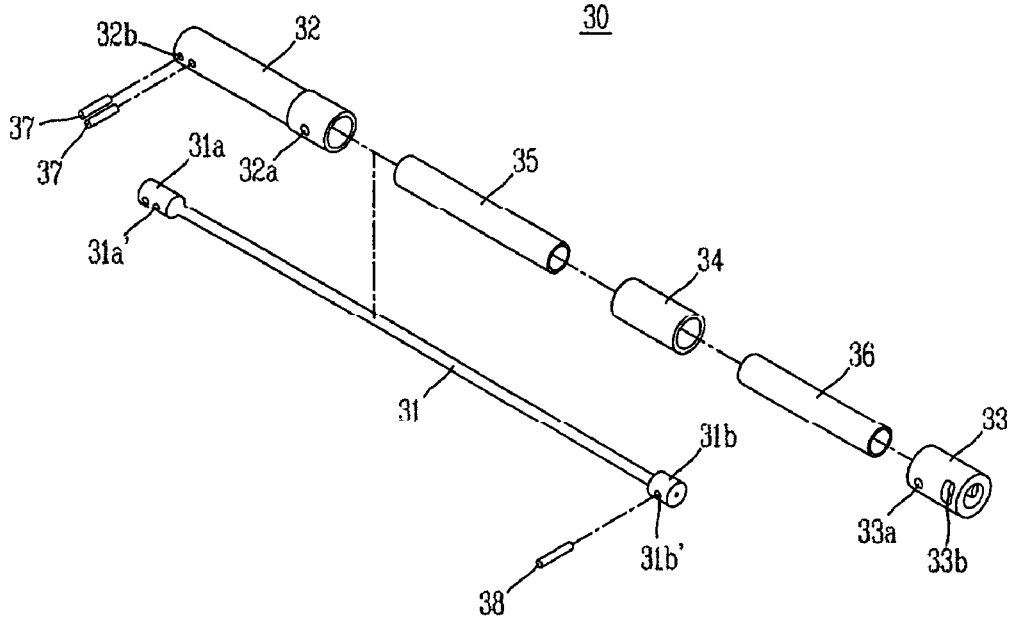
FIG. 3A is a disassembled perspective view of a deploying portion.
Figure 3B:
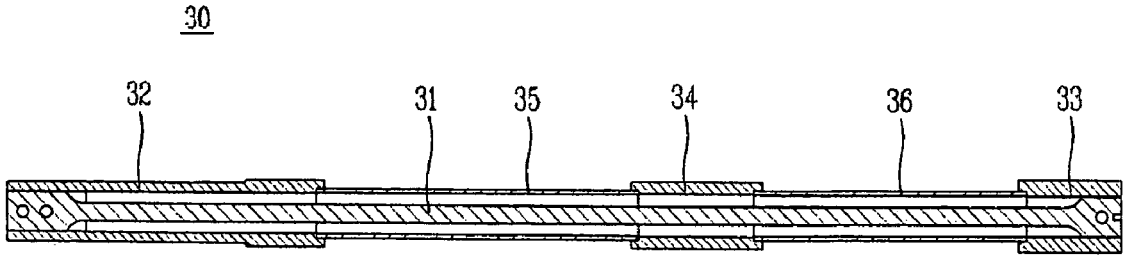
FIG. 3B is a sectional view showing an assembled deploying portion.

FIG. 3A is a disassembled perspective view of the deploying portion, and FIG. 3B is a sectional view showing the deploying portion of an assembled state.

The deploying portion 30 comprises a torsion bar 31, a first shaft 32, a second shaft 33, a middle shaft 34, and spacers 35 and 36.

The torsion bar 31 has a bar shape extending in a longitudinal direction, and accumulates elastic energy as both ends thereof are rotated in opposite directions. When the torsion bar 31 restores the original state, the accumulated elastic energy is emitted and thus the rotary wing 10 is rotated. Both ends of the torsion bar 31, that is, a first end 31*a* and a second end 31*b* are respectively provided with a coupling hole 31*a'* and a coupling hole 31*b'*. A fixing pin 37 and a rotating pin 38 are respectively inserted into the coupling holes 31*a'* and 31*b'*.

The first shaft 32 and the second shaft 33 have a cylindrical shape to cover the first end 31*a* and the second end 31*b* of the torsion bar 31. A fixing pin 25 (see FIG. 4A) is inserted into the coupling hole 32*a* of the first shaft 32, and the fixing pin 37 is sequentially inserted into the coupling hole 32*b* and the coupling hole 31*a'*, thereby fixing the first end 31*a* of the torsion bar 31 and the first shaft 32 to the fixed wing 20.

On the contrary, a fixing pin 16 of FIG. 2A connected to the rotary wing 10 is inserted into the coupling hole 33*a* of the second shaft 33, thereby coupling the second shaft 33 to the rotary wing 10. The second shaft 33 is coupled to the rotary wing 10 by the rotating pin 38 simultaneously inserted into a cut-out portion 33*b* and the coupling hole 31*b'* of the second end 31*b* of the torsion bar 31.

The cut-out portion 33*b* of the second shaft 33 is cut out with a certain angle, so that the second end 31*b* of the torsion bar 31 connected to the second shaft 33 by the rotating pin 38 is not influenced within a range of a certain angle even when the second shaft 33 is rotated.

At least one middle shaft 34 is disposed between the first shaft 32 and the second shaft 33. A first spacer 35 is disposed between the first shaft 32 and the middle shaft 34, and a second spacer 36 is disposed between the middle shaft 34 and the second shaft 33 in order to maintain a certain gap therebetween. The torsion bar 31 is completely covered by the first shaft 32, the second shaft 33, the middle shaft 34, and the spacers 35 and 36. Under the state, the torsion bar 31 completely fills the upper spaces 12*a* and 12*b* of the rotary wing 10 and the upper spaces 22*a* and 22*b* of the fixed wing 20. The torsion bar 31 can be installed in the spaces 12*a*, 12*b*, 22*a*, and 22*b* without a free play due to the interposing of the middle shaft 34, so that the rotary wing 10 is not free-played by the deploying portion 30 (refer to FIG. 5).

Figure 4A:
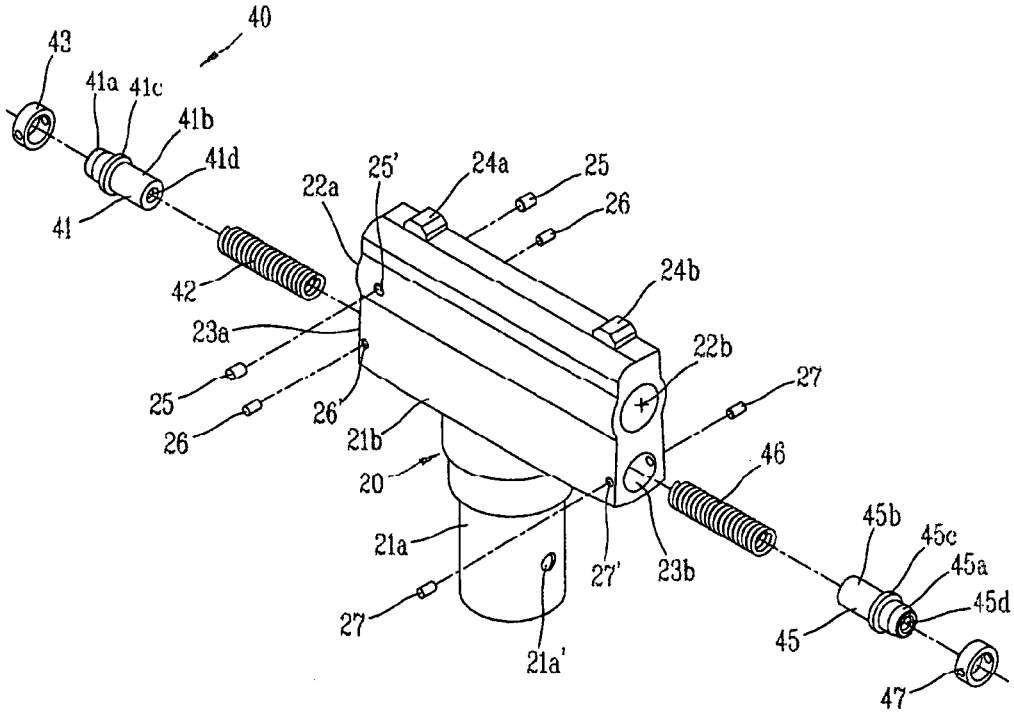
FIG. 4A is a disassembled perspective view of the fixed wing and a locking means.
Figure 4B:
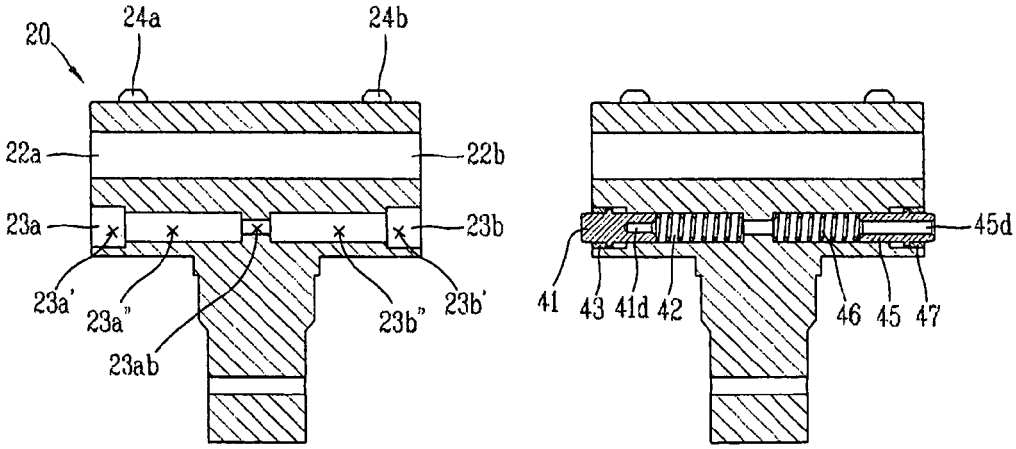
FIG. 4B is a sectional view showing a coupled state between the fixed wing and the locking means.

FIG. 4A is a disassembled perspective view of the fixed wing and the locking means, and FIG. 4B is a sectional view showing a coupled state between the fixed wing and the locking means.

As shown in FIG. 4A, the fixed wing 20 comprises a body connection portion 21*a* and a rotary wing connection portion 21*b*.

The body connection portion 21*a* has a cylindrical shape, and is fixed to the body of the guided missile through a body connection hole 21*a'*.

The rotary wing connection portion 21*b* is extending in a perpendicular direction to the body connection portion 21*a*. Upper spaces 22*a* and 22*b* and lower spaces 23*a* and 23*b* of the rotary wing connection portion 21*b* are respectively penetrated. Fixing protrusions 24*a* and 24*b* are protruding from an upper side of the rotary wing connection portion 21*b*, and thus is coupled to the protrusion grooves 14*a* and 14*b* of the rotary wing 10.

As aforementioned, the deploying portion 30 is penetratingly-installed at the upper spaces 22*a* and 22*b*. Herein, the first shaft 32 of the deploying portion 30 is fixed to a coupling hole 25' by the fixing pin 25.

The locking means 40 is installed at the lower spaces 23*a* and 23*b*.

The locking means 40 comprises first and second locking pins 41 and 45, first and second elastic members 42 and 46 (or compression springs), and first and second bushings 43 and 47.

The first and second locking pins 41 and 45 are hollow bars, and each front end thereof 41*a* and 45*a* has a tapered shape. Rear ends 41*b* and 45*b* of the first and second locking pins 41 and 45 are extending from the front ends 41*a* and 45*a* with a certain length under a state that protruded ring portions 41*c* and 45*c* each having a diameter larger than that of the front ends 41*a* and 45*a* are disposed therebetween. A female screw thread is formed at a space portion 41*d* of the first locking pin 41, and a screw portion 51*a* of a second folding means 51 is coupled to the female screw thread (refer to FIG. 7B).

The first and second bushings 43 and 47 are fitted into the front ends 41*a* and 45*a* of the first and second locking pins 41 and 45, and are fixed by the protruded ring portions 41*c* and 45*c*. The bushings 43 and 47 are fixed to the lower spaces 23*a* and 23*b* of the fixed wing 20 by a fixing pin (not shown), etc.

As shown in FIG. 4B, for the installation of the locking means 40, the lower spaces 23*a* and 23*b* are respectively divided into first chambers 23*a'* and 23*b'* having a larger diameter and second chambers 23*a"* and 23*b"* having a relatively smaller diameter. The second chambers 23*a"* and 23*b"* are connected to each other by a connection portion 23*ab* having a diameter smaller than that of the second chambers 23*a"* and 23*b"*.

The first and second compression springs 42 and 46 are inserted into the second chambers 23*a"* and 23*b"* having a relatively small diameter. Also, the first and second locking pins 41 and 45 are inserted into the second chambers 23*a"* and 23*b"* and the first chambers 23*a'* and 23*b'* thus to be outwardly supported by elastic forces of the first and second compression springs 42 and 46. The first and second bushings 43 and 47 (or limitation members) are fitted into the front ends 41*a* and 45*a* of the first and second locking pins 41 and 45 thus to be fixed to the first chambers 23*a'* and 23*b'*, thereby preventing the first and second locking pins 41 and 45 from being detached therefrom outwardly. Under the construction, only the front ends 41*a* and 45*a* of the first and second locking pins 41 and 45 are exposed outwardly.

A process for deploying the rotary wing centering around the fixed wing will be explained with reference to FIG. 5 or FIG. 2A.

Figure 5:
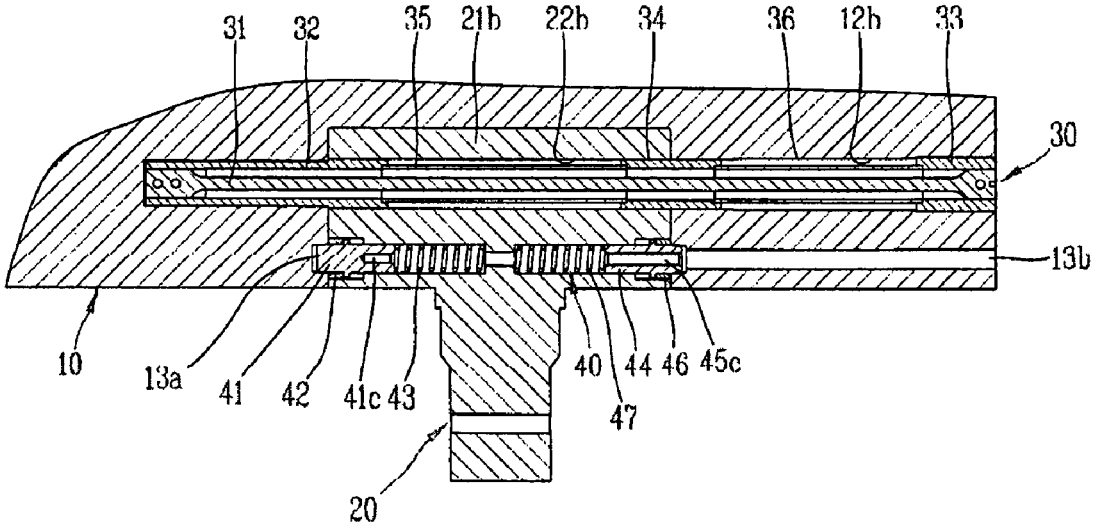
FIG. 5 is a sectional view showing a state that the rotary wing is deployed centering around the fixed wing.

FIG. 5 is a sectional view showing a state that the rotary wing is deployed centering around the fixed wing.

As shown, the rotary wing connection portion 21*b* of the fixed wing 20 is inserted into the cut-out coupling portion 11 of the rotary wing 10. The deploying portion 30 is inserted into the upper space 12*a* of the rotary wing 10 via the upper space 12*b* of the rotary wing 10, the upper space 22*b* of the fixed wing 20, and the upper space 22*a* of the fixed wing 20, sequentially. The first shaft 32 of the deploying portion 30 is fixed to the fixed wing 20 by the fixing pin 25, and the second shaft 33 is fixed to the rotary wing 10 by the fixing pin 16.

The first shaft 32 and the second shaft 33 are respectively coupled to the first end 31*a* and the second end 31*b* of the torsion bar 31. Accordingly, when the rotary wing 10 becomes a folded state by rotating centering around the fixed wing 20 (refer to FIG. 1), the first end 31*a* is fixed and the second end 31*b* is rotated thereby to accumulate torsion energy. Under the state, when the body of the guided missile mounted in the launcher is separated from the launcher, the torsion energy is applied and thus the rotary wing 10 is deployed in parallel with the fixed wing 20.

The first locking pin 41 and the second locking pin 45 of the locking means 40 are respectively frictional with the inclined surfaces 15*a'* and 15*b'* of the rotary protrusions 15*a* and 15*b*. Then, the first and second locking pins 41 and 45 overcome a repulsive force of the first and second compression springs 42 and 46, and are moved towards the inner side of the fixed wing 20. The front ends 41*a* and 45*a* of the first locking pin 41 and the second locking pin 45 respectively have a tapered shape in order to easily slide from the inclined surfaces 15*a'* and 15*b'* of the rotary protrusions 15*a* and 15*b*.

When the rotary wing 10 is rotated thus to be deployed, the front ends 41*a* and 45*a* of the first locking pin 41 and the second locking pin 45 are in a straight line with the lower spaces 13*a* and 13*b* of the rotary wing 10, respectively. Herein, the front ends 41*a* and 45*a* of the first locking pin 41 and the second locking pin 45 are respectively inserted into the lower spaces 13*a* and 13*b* by the first and second compression springs 42 and 46, thereby firmly fixing the rotary wing 10 of an unfolded state.

The second shaft 33 is provided with a cut-out portion 33*b* cut out within a range of a certain angle. The second shaft 33 and the rotary wing 10 connected to the second shaft 33 can be much more rotated without twisting the torsion bar 31 in a certain section, which will be explained in more detail with reference to FIGS. 6A to 6C.

Figure 6A:
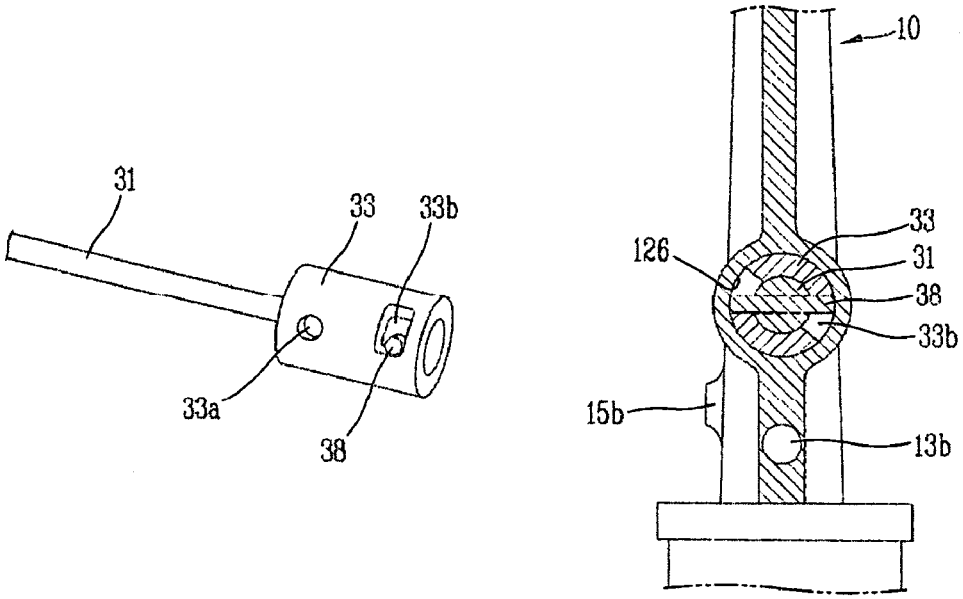
FIG. 6A is a view for explaining a relation between a second shaft and a rotating pin when the rotary wing is deployed.

FIG. 6A is a view for explaining a relation between a second shaft and a rotating pin when the rotary wing is deployed.

As shown, the deployed rotary wing 10 is arranged to be in a straight line with the fixed wing 20. The fixing pin 16 is inserted into the coupling hole 33*a* of the second shaft 33, thereby fixing the second shat 33 to the rotary wing 10.

The rotating pin 38 inserted into the coupling hole 31*b'* of the second end 31*b* of the torsion bar 31 is inserted into the cut-out portion 33*b* of the second shaft 33. The cut-out portion 33*b* is cut-out within a range of a certain angle along a rotation direction of the torsion bar 31 and the rotating pin 38.

The rotating pin 38 is horizontally disposed in drawing.

Under a state that the rotary wing 10 is deployed, the rotating pin 38 coupled to the torsion bar 31 comes in contact with a lower end of the cut-out portion 33*b*. Accordingly, even if the rotary wing 10 connected to the second shaft 33 is folded, the second end 31*b* of the torsion bar 31 is not rotated within a range of a certain angle but only the second shaft 33 is freely rotated.

Figure 6B:
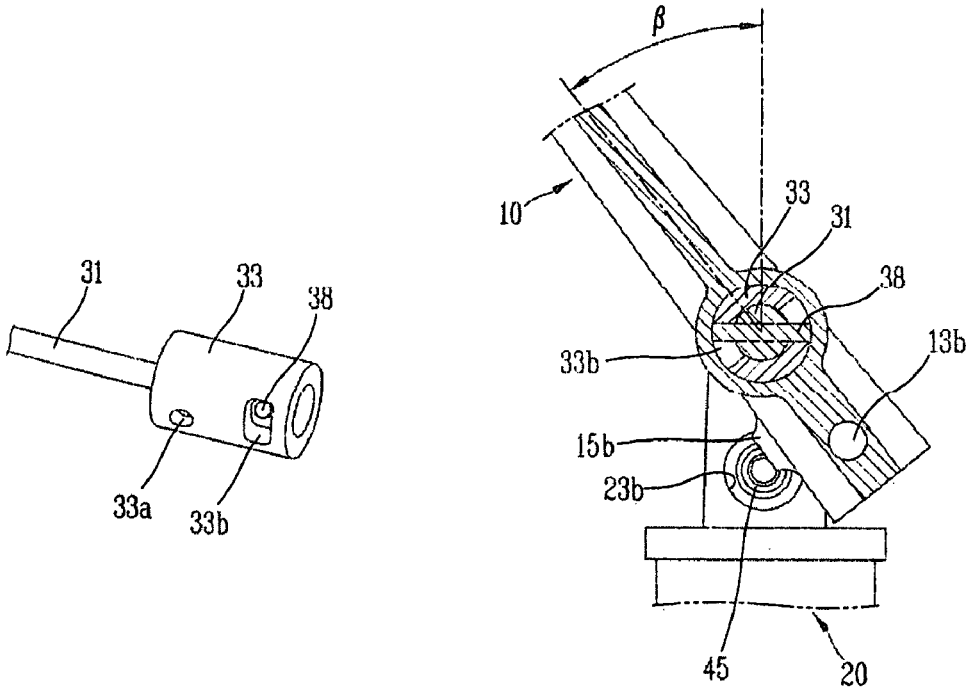
FIG. 6B is a view for explaining a state that the second shaft has been freely-rotated as the rotary wing becomes a folded state.

FIG. 6B is a view for explaining a state that the second shaft has been freely-rotated as the rotary wing becomes a folded state.

As the rotary wing 10 and the second shaft 33 are counterclockwise rotated, they come in contact with an upper end of the cut-out portion 33*b* of the second shaft 33.

However, since the rotating pin 38 is arranged in a horizontal direction, any torsion force is not applied to the torsion bar 31. As the result, the rotary wing 10 and the second shaft 33 are freely rotated within a range of a second angle (β) without influencing on the torsion bar 31.

Figure 6C:
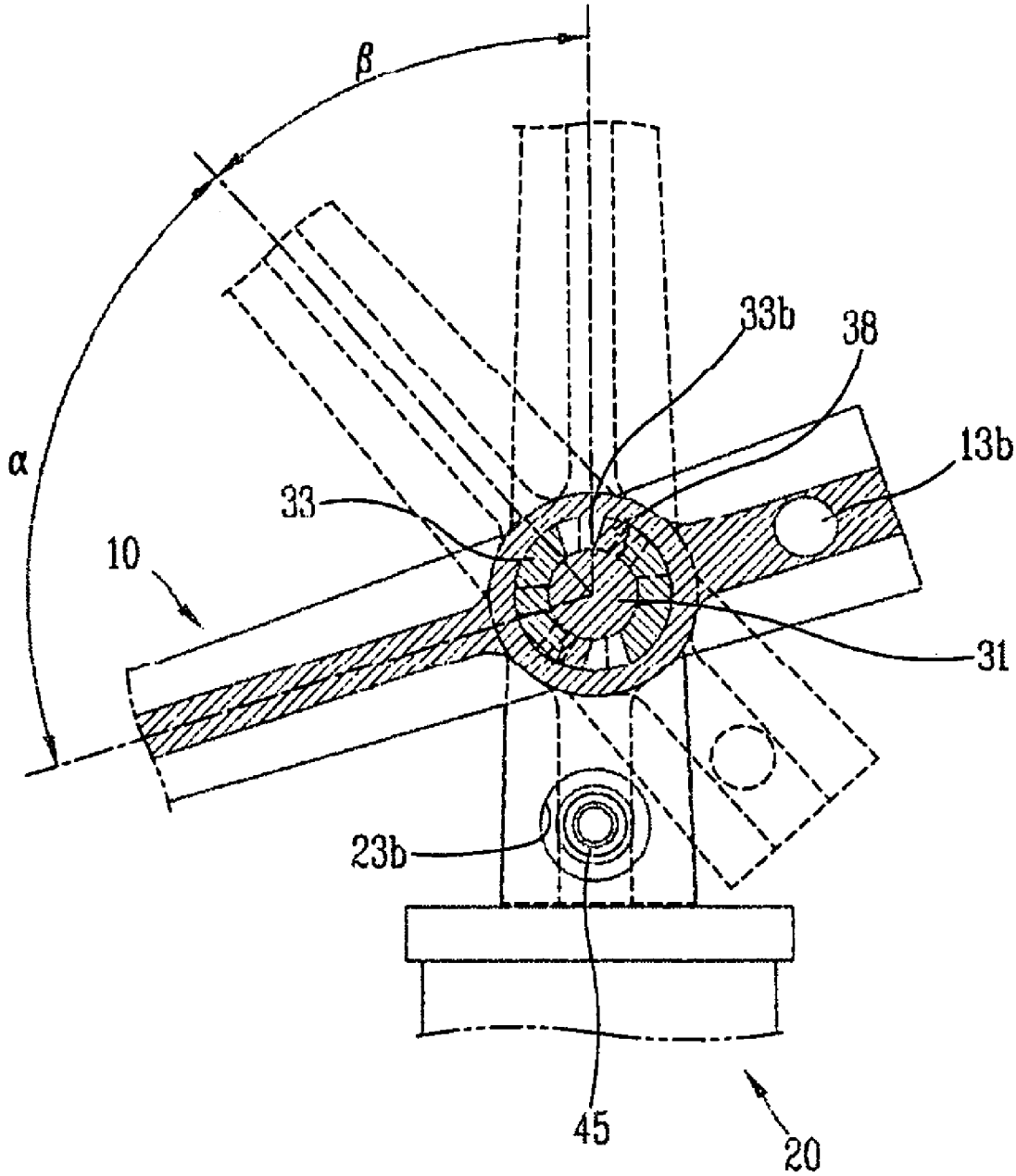
FIG. 6C is a view for explaining a relation between the second shaft and the rotating pin when the rotary wing becomes a folded state after performing an initial free rotation.

FIG. 6C is a view for explaining a relation between the second shaft and the rotating pin when the rotary wing becomes a folded state after performing an initial free rotation.

As shown in FIG. 6B, the rotating pin 38 comes in contact with the upper end of the cut-out portion 33*b* of the second shaft 33, and receives a rotation force of the rotary wing 10. As the result, the rotating pin 38 is counterclockwise rotated thus to be deviated from the first horizontal state, which means that the second end 31*b* receives a torsion force. The rotary wing 10 becomes a folded state.

In a process that the rotary wing 10 is rotated from an unfolded state to a folded state, an angle that can influence on the torsion bar 31 is only within a range of a first angle (α). That is, the rotary wing 10 is rotated within a range of a sum angle (α)+(β) between the first angle (α) and the second angle (β) while it becomes a folded state from an unfolded state. However, when the rotary wing 10 is rotated within a range of the second angle (β), it does not influence on the torsion bar 31. As the result, the rotary wing 10 can be more folded by the range of the second angle (β) without influencing on the torsion bar 31.

A construction to minimize a free play between the rotary wing 10 that has been deployed and the fixed wing 20 will be explained with reference to FIGS. 7A and 7B.

Figure 7A:
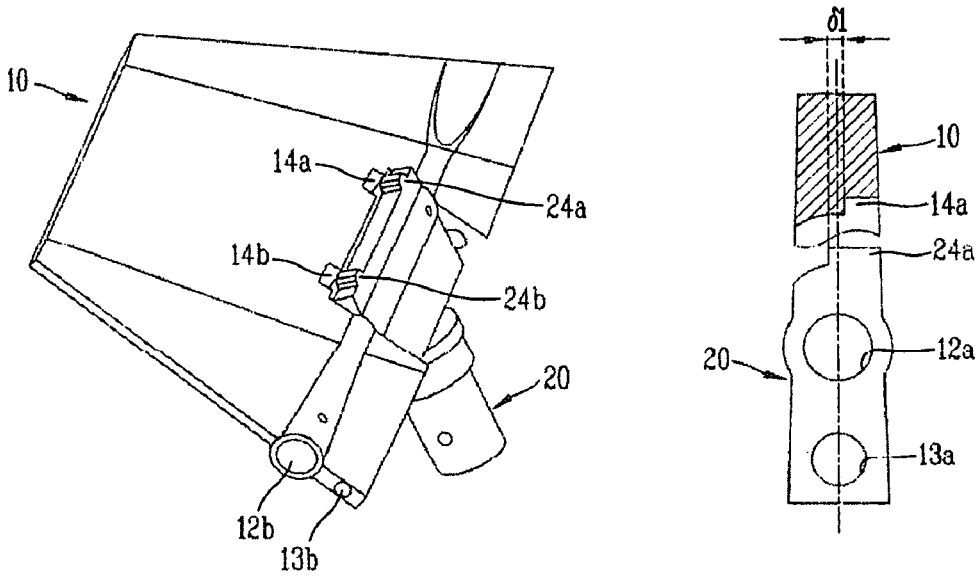
FIG. 7A are views respectively showing a state that the rotary wing is being converted into an unfolded state from a folded state and a completely unfolded state of the rotary wing.
Figure 7B:
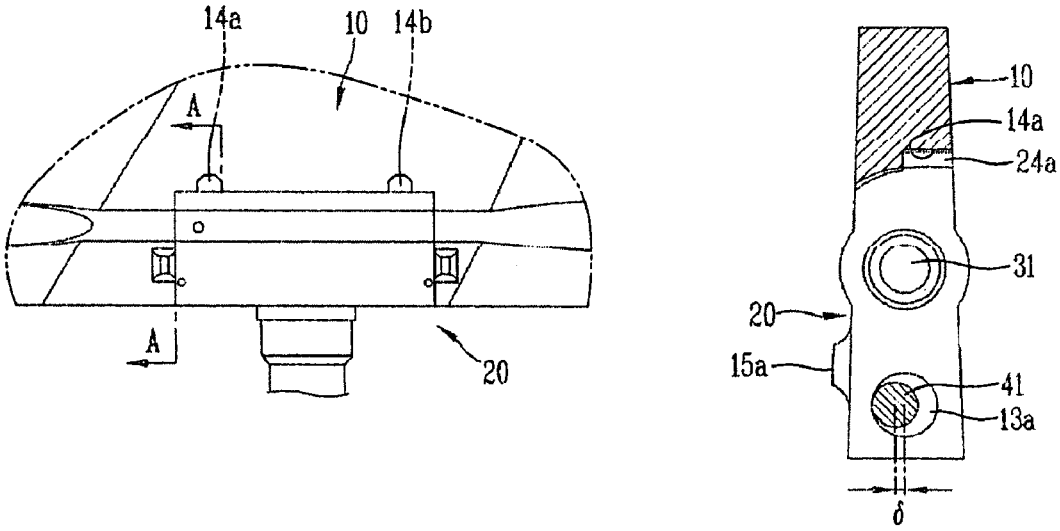
FIG. 7B are respectively a frontal view showing a completely unfolded state of the rotary wing, and a sectional view taken along line 'A-A' of the frontal view.

FIG. 7A are views respectively showing a state that the rotary wing is being converted into an unfolded state from a folded state and a completely unfolded state of the rotary wing, and FIG. 7B are respectively a frontal view showing a completely unfolded state of the rotary wing, and a sectional view taken along line 'A-A' of the frontal view.

Referring to FIG. 7A, a rotation radius of the first and second locking pins 41 and 45 is shorter than that of the fixing protrusions 24*a* and 24*b* of the fixed wing 20, and the protrusion grooves 14*a* and 14*b* of the rotary wing 10 are overlapped with the fixing protrusions 24*a* and 24*b* of the fixed wing 20 to some degree, that is, a protruded degree (δ1) of the fixing protrusion 24*a* is larger than a concaved depth of the protrusion groove 14*a*. Accordingly, when the rotary wing 10 is deployed, the protrusion grooves 14*a* and 14*b* of the rotary wing 10 come in contact with the fixing protrusions 24*a* and 24*b* of the fixed wing 20.

As the result, as shown in FIG. 7B, a certain gap (δ) is generated between a center axis of each of the tapered front ends 41*a* and 45*a* of the first and second locking pins 41 and 45 and a center axis of each of the lower spaces 13*a* and 13*b* of the rotary wing 10.

Herein, a repulsive force generated from the protrusion grooves 14*a* and 14*b* of the rotary wing 10 that come in contact with the fixing protrusions 24*a* and 24*b* of the fixed wing 20 and a repulsive force generated from the lower spaces 13*a* and 13*b* of the rotary wing 10 that come in contact with the first and second locking pins 41 and 45 are operated in opposite directions on the basis of the deploying portion 30 (or the torsion bar 31). As the result, a free play is not generated.

Next, a process for folding the rotary wing will be explained with reference to FIGS. 8A and 8B or FIG. 5.

Figure 8A:
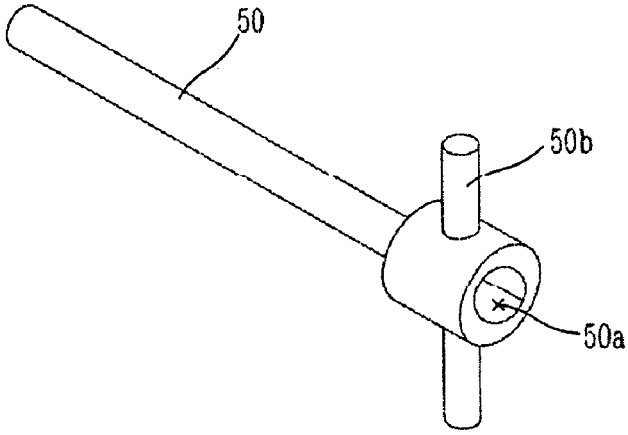
FIG. 8A is a perspective view showing a first folding means for the rotary wing.
Figure 8B:
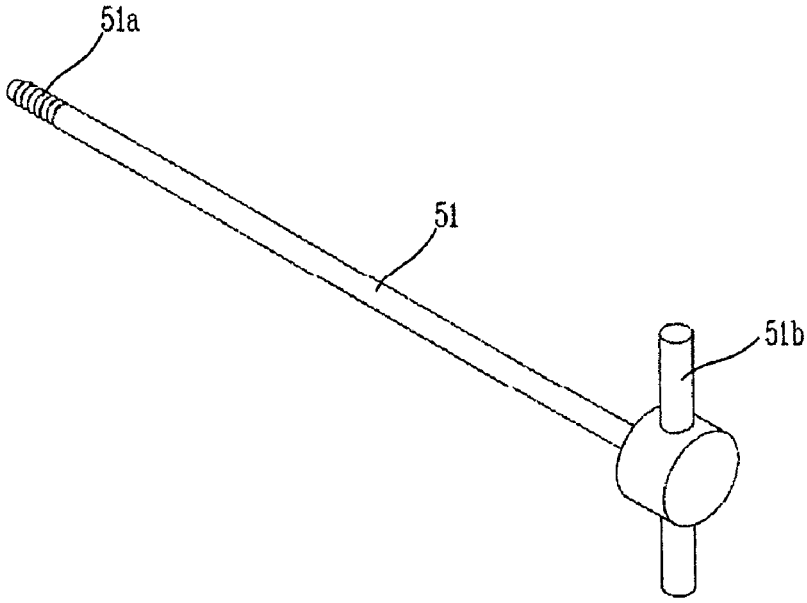
FIG. 8B is a perspective view showing a second folding means inserted into the first folding means.

FIG. 8A is a perspective view showing a first folding means, and FIG. 8B is a perspective view showing a second folding means inserted into the first folding means.

The first folding means 50 is a bar type having a hollow space portion 50*a* and extending in a longitudinal direction. A handle 50*b* is coupled to one end of the first folding means 50 in a perpendicular direction to the longitudinal direction. The second folding means 51 has a sectional area enough to be inserted into the space portion 50*a* of the first folding means 50. A screw portion 51*a* of a male screw thread is formed at one end of the second folding means 51, and a handle 51*b* is formed at another end of the second folding means 51.

In order to convert a deployed state of the rotary wing 10 of the guided missile into a folded state, the first folding means 50 is inserted into the lower space 13*b* of the rotary wing 10 until it comes in contact with the front end 45*a* of the second locking pin 45. Then, the second folding means 51 is inserted into the space portion 50*a* so as to reach the first locking pin 41 via the space portion 45*c* of the second locking pin 45 and the space portions 23*a* and 23*b* of the fixed wing 20. Herein, if the second folding means 51 is clockwise rotated, the screw portion 51*a* of the second folding means 51 is engaged with the screw thread of the space portion 41*d* of the first locking pin 41. Under the state, if the second folding means 51 is pulled, the front end 41*a* of the first locking pin 41 that has been inserted into the lower space 23*a* of the rotary wing 10 is separated from the lower space 23*a*.

Also, if the handle 50*b* of the first folding means 50 is pushed in an insertion direction, the front end 45*a* of the second locking pin 45 is detached out of the lower space 13*b* of the rotary wing 10. Under the state, if the rotary wing 10 is folded by approximately 1° and then the second folding means 51 is counterclockwise rotated, the second folding means 51 is separated from the space portion 41*d*. Furthermore, if the second folding means 51 is pulled in an opposite direction to the insertion direction, the second folding means 51 is completely separated form the space portion 41*d* of the first locking pin 41. Also, if the first folding means 50 and the second folding means 51 are pulled in an opposite direction to the insertion direction, they are completely separated from the lower space 13*b* of the rotary wing 10. Then, the rotary wing 10 is folded to some degree thus to be mounted at the launcher.

As aforementioned, in the apparatus for deploying a wing of a guided missile, the rotary wing has a free rotation section not influencing on the deploying unit (especially, the torsion bar) thereby to maximize a folded degree.

Also, when the rotary wing has been deployed, the locking means fixes the rotary wing so as not to rotate centering around the fixed wing. Accordingly, the deployed state of the rotary wing can be stably maintained.

Furthermore, since the fixing protrusion is overlapped with the protrusion groove with a certain thickness, even a minute free play can be removed and thus the deployed state of the rotary wing can be more stably maintained.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An apparatus for deploying a wing of a guided missile, comprising:

a fixed wing fixedly coupled to a body of a guided missile;

a rotary wing rotatably coupled to the fixed wing;

a deploying portion for rotating the rotary wing into an unfolded state from a folded state by providing a torsion force to the rotary wing, and having a torsion bar disposed to penetrate the fixed wing and the rotary wing, one end of the torsion bar being connected to the fixed wing and another end of the torsion bar being connected to the rotary wing; and wherein the torsion bar is configured not to be rotatable within a prescribed angle by rotation of the rotary wing.

2. The apparatus of claim 1, wherein the deploying portion further comprises:

a first shaft disposed to be coupled to one end of the torsion bar and fixed to the fixed wing with the one end of the torsion bar; and a second shaft disposed to be coupled to another end of the torsion bar and configured to be rotated with the another end of the torsion bar within another prescribed angle rather than the prescribed angle.

3. The apparatus of claim 2, wherein the second shaft is provided with an elongated cut-out portion, and the second shaft is coupled to the another end of the torsion bar by a rotating pin through the cut-out portion, wherein the rotating pin is movable with respect to the cut-out portion along the elongated direction of the cut-out portion.

4. The apparatus of claim 2, wherein at least one middle shaft is interposed between the first shaft and the second shaft, and a spacer is respectively disposed between the first shaft and the middle shaft and between the middle shaft and the second shaft.

5. The apparatus of claim 1, further comprising a locking means installed in the fixed wing for fixing a deployed state of the rotary wing by being inserted into the rotary wing when the rotary wing is deployed.

6. The apparatus of claim 5, wherein the locking means comprises:

an elastic member disposed in the fixed wing;

a locking pin elastically supported by the elastic member towards outside of the fixed wing, and having one end exposed outwardly; and a limitation member for restricting the locking pin not to be separated from lo the fixed wing.

7. The apparatus of claim 6, wherein the elastic member is a compression spring, and the limitation member is a bushing fitted into the exposed end of the locking pin and fixed to the fixed wing.

8. The apparatus of claim 6, wherein a rotary protrusion protruding with an inclined surface for moving the locking pin into the fixed wing by being in contact with the locking pin when the rotary wing is rotated is formed at the fixed wing.

9. The apparatus of claim 8, wherein the outwardly exposed end of the locking pin is tapered.

10. The apparatus of claim 6, wherein a protrusion groove is concaved at one of the rotary wing and the fixed wing, a fixing protrusion inserted into the protrusion groove when the rotary wing is deployed is protruding at another of the rotary wing and the fixed wing, a protruded degree of the fixing protrusion is larger than a depth of the protrusion groove, and the locking pin is eccentrically disposed from an axis of a lower space portion of the rotary wing and generates a rotation torque in an opposite direction to a direction of a rotation torque applied to the rotary wing by the protruded degree of the fixing protrusion thereby to prevent a free play between the rotary wing and the fixed wing.

11. The apparatus of claim 1, wherein a protrusion groove is concaved at one of the rotary wing and the fixed wing, a fixing protrusion inserted into the protrusion groove when the rotary wing is deployed is protruding at another of the rotary wing and the fixed wing, and a protruded degree of the fixing protrusion is larger than a depth of the protrusion groove.

12. The apparatus of claim 1, wherein the rotary wing has a plate shape of which a center portion is cut-out, and the fixed wing comprises a rotary wing connection portion having a shape corresponding to the cut-out portion of the rotary wing and inserted into the rotary wing, and a body connection portion connected to a body of the guided missile.

* * * * *